United States Patent [19]

Sano et al.

[11] Patent Number: 4,461,821

[45] Date of Patent: Jul. 24, 1984

[54] PHOTOCONDUCTIVE COMPOSITIONS AND ELECTROPHOTOGRAPHIC PHOTOSENSITIVE MATERIALS COMPRISING AN ORGANIC PHOTOCONDUCTOR AND A THIOUREA COMPOUND

[75] Inventors: Kenji Sano; Syunichi Kondo; Hideo Sato, all of Saitama, Japan

[73] Assignee: Fuji Photo Film Co., Ltd., Kanagawa, Japan

[21] Appl. No.: 434,659

[22] Filed: Oct. 15, 1982

[30] Foreign Application Priority Data

Oct. 15, 1981 [JP] Japan ..... 56-165261

[51] Int. Cl.[3] ..... G03G 5/04

[52] U.S. Cl. ..... 430/83; 430/81

[58] Field of Search ..... 430/83, 71, 70, 75, 430/569, 81

[56] References Cited

U.S. PATENT DOCUMENTS 3,891,990 6/1975 Wells ..... 430/48

3,955,996 5/1976 Hinata et al. ..... 430/569

*Primary Examiner*—John E. Kittle

*Assistant Examiner*—John L. Goodrow

*Attorney, Agent, or Firm*—Sughrue, Mion, Zinn, Macpeak & Seas

[57] ABSTRACT

A light-sensitive organic photoconductorcontaining photoconductive composition for electrophotography is disclosed. The composition has greatly increased light sensitive created by the incorporation of a thiourea compound. The photoconductive composition may further contain a sensitizing dye capable of increasing the sensitivity of the organic photoconductor.

8 Claims, No Drawings

PHOTOCONDUCTIVE COMPOSITIONS AND ELECTROPHOTOGRAPHIC PHOTOSENSITIVE MATERIALS COMPRISING AN ORGANIC PHOTOCONDUCTOR AND A THIOUREA COMPOUND

FIELD OF THE INVENTION

This invention relates to a photoconductive composition mainly composed of an organic photoconductor and also an electrophotographic photosensitive material which uses the photoconductive composition for its electrophotographic photosensitive layer. More particularly, the invention relates to a high-sensitive photoconductive composition mainly composed of an organic photoconductor and a thiourea compound and also a high-sensitive electrophotographic photosensitive material which uses the composition for the electrophotographic photosensitive layer.

BACKGROUND OF THE INVENTION

There are a number of organic compounds which are known to be useful as photoconductors for electrophotographic photosensitive compositions. Some of these compounds are known to have considerably high light sensitivity. However, these organic photoconductors are not practically used for electrophotographic materials.

Organic photoconductors have many excellent properties as compared to inorganic photoconductors and are widely applicable to techniques in the technical field of electrophotography. For example, the production of transparent electrophotographic photosensitive films, flexible electrophotographic photosensitive films, or light and easily handling electrophotographic photosensitive films has been made possible by using organic photoconductors. Organic photoconductors also have such properties as a film-forming property with respect to the preparation of electrophotographic photosensitive materials. In addition, they are useful in obtaining surface smoothness, and selectivity of charging polarity when applied to an electro photographic process. These properties and effects can not be obtained using inorganic photoconductors.

In spite of these excellent properties, organic photoconductors have not yet been widely used in the technical field of electrophotography mainly because of their low light sensitivity and the brittleness of films formed by such organic photoconductors.

The first study of organic photoconductors was made on compounds such as heterocyclic compounds having a low molecular weight, nitrogen-containing aromatic compounds, and various high molecular aromatic compounds. Thus, some compounds having considerably high sensitivity have been found. Recently, a sensitization method has been investigated in order to obtain higher sensitivity. Such studies have been made because even the organic photosemiconductor compounds having the highest sensitivity do not have enough sensitivity to make them practically useful without need of a sensitization treatment. Therefore, when using organic photoconductors, it is necessary to select and apply a most effective sensitizing method. Furthermore, the industrial value of organic photoconductors clearly depends upon the extent of the sensitivity of the electrophotographic photosensitive material finally obtained by the employed sensitizing method.

The most generally known sensitizing methods are the addition of sensitizing dye and the addition of Lewis acid. These methods can be applied to almost all organic photoconductors. In the former method, high sensitivity is obtained by imparting the spectral absorbing character of a dye to an organic photoconductor and in the latter method, high sensitivity is obtained by the appearance of new spectral sensitivity by the formation of a complex of a donor and an acceptor in an organic photoconductor.

SUMMARY OF THE INVENTION

As the result of various investigations on further sensitizing an organic photoconductor which was already dye sensitized, it has been discovered that the light sensitivity is greatly increased by the addition of a thiourea compound to the organic photoconductor.

A primary object of this invention is to provide an excellent sensitizing method for organic photoconductors and to provide sensitizers which can give sufficiently high-sensitive electrophotographic photosensitive materials.

Another object of this invention is to provide transparent electrophotographic photosensitive films, light and easily handling electrophotographic photosensitive films, and high-sensitive electrophotographic photosensitive film which can be practically used. These and other objects can be achieved by the present invention.

That is, according to the invention, there is provided a photoconductive composition comprising (a) an organic photoconductor and (b) a thiourea compound.

According to another embodiment of this invention, there is further provided an electrophotographic photosensitive material comprising a support having electric conductivity at least the surface thereof having formed thereon a layer of a photoconductive composition comprising (a) an organic photoconductor and (c) a thiourea compound.

The photoconductive composition of this invention may further contain (b) a sensitizing dye capable of increasing the light sensitivity of the organic photoconductor.

In a particular embodiment of this invention, the thiourea compound of the photoconductive composition is represented by general formula I or II;

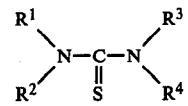

I

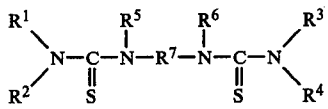

II wherein $R^1$, $R^2$, $R^3$, $R^4$, $R^5$, and $R^6$, which may be the same or different, each represents a hydrogen atom, an alkyl group, a monovalent group induced from a monocyclic or bicyclic condensed aryl group, or a monovalent group induced from a monocyclic or bicyclic condensed heterocyclic ring; said $R^1$ and $R^2$ or said $R^3$ and $R^4$ may combine with each other; and said $R^1$ to $R^4$ in general formula I may combine with each other to form a ring; and $R^7$ represents a divalent arylene group, a polymethylene group, or an alkylene group.

DESCRIPTION OF THE PREFERRED EMBODIMENTS

The photoconductive composition of this invention is composed of (a) an organic photoconductor and (c) a thiourea compound as the main components. The organic photoconductor (a) will disclosed and described below. Any organic photoconductors which can be dye sensitized may be used in this invention and practical examples are as follows:

(i) High molecular organic photoconductors:

High molecular weight organic photoconductors each containing a polycyclic aromatic ring or a heterocyclic aromatic ring composed of a vinyl polymer-type polymer having a $\pi$-electron system at the main chain or the side chain.

Typical examples of the electron system contained in the high molecular organic photoconductors used in this invention include polycyclic aromatic hydrocarbons such as naphthalene, anthracene, pyrene, perylene, acenaphthene, phenylanthracene, diphenylanthracene, etc.; heterocyclic aromatic compounds such as carbazole, indole, acridine, 2-phenylindole, N-phenylcarbazole, etc.; and the halogen or lower alkyl substituents of them. Polymers having these $\pi$-electron systems are used as the photoconductive polymers in this invention. Examples of these polymers include vinyl polymers such as polyvinylnaphthalene, polyvinylanthracene, polyvinylpyrene, polyvinylperylene, polyacenaphthylene, polystyrylanthracene, polyvinylcarbazole, polyvinylindole, polyvinylacridine, etc.; vinyl copolymers containing the above vinyl compound, such as vinyl naphthalene, vinylacenapthylene, vinyl anthracene, vinyl carbazole, etc.; vinyl ether polymers such as polyanthrylmethylvinyl ether, polypyrenylmethylvinyl ether, polycarbazolylethylvinyl ether, polyindolyethylvinyl ether, etc.; epoxy resins such as polyglycidyl carbazole, polyglycidyl indole, poly-p-glycidyl anthrylbenzene, etc.; polymers or copolymers such as polyacrylic acid esters and polymethacrylic acid esters containing the foregoing $\pi$-electron system as a substituent; and the condensed polymers of the foregoing $\pi$-electron system compounds and formaldehyde.

Among these compounds preferred ones include poly-N-vinylcarbazole, poly-N-vinylcarbazole having a substituent such as an aryl group, alkaryl group, amino group, alkylamino group, dialkylamino group, arylamino group, diarylamino group, N-alkyl-N-arylamino group, nitro group, halogen atom, etc., at the carbazole ring (hereinafter, these carbazoles are referred to as poly-N-vinyl-substituted carbazoles), and N-vinylcarbazole copolymers. The poly-N-vinyl substituted-carbazole and copolymers thereof have 1,000 to 10,000,000, preferably 10,000 to 200,000 of molecular weight.

N-vinylcarbazole copolymers which are useful include copolymers containing more than 50%, preferably more than 70% N-ethylenecarbazole constitutional repeating unit having the following formula:

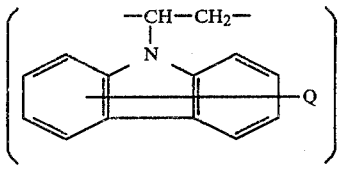

wherein Q represents the same substituent as that of the foregoing poly-N-vinyl-substituted carbazoles.

Examples of the remaining constitutional repeating unit of the N-vinylcarbazole copolymers include 1-phenylethylene, 1-cyanoethylene, 1-cyano-1-methylethylene, 1-chloroethylene, 1-(alkoxy carbonyl-)ethylene, 1-alkoxycarbonyl-1-methylethylene (each being the constitutional repeating unit originated in styrene, acrylonitrile, methacrylonitrile, vinyl chloride, alkyl acrylate, and alkyl methacrylate). Examples of the alkyl group of the alkoxycarbonyl group include an alkyl group having 1 to 18 carbon atoms, preferably 1 to 5 carbon atoms and specific examples include a methyl group, an ethyl groups, a hexyl group, a dodecyl group, an octadecyl group, and a 4-methylcyclohexyl group. The constitutional repeating unit is described in "Kobunshi"; Vol. 27, 345–359(1978) and "Pure and Applied Chemistry"; Vol. 48, 373–385(1976), Japanese translation.

(ii) Aromatic tertiary amino compounds:

Triphenylamine, N,N-dibenzylaniline, diphenylbenzylamine, N,N-di(p-chlorobenzyl)aniline, di($\beta$-naphthyl)benzylamine, tri(p-tolyl)amine, and diphenylcyclohexylamine.

(iii) Aromatic tertiary diamino compound:

N,N,N′,N′-Tetrabenzyl-p-phenylenediamine, N,N,N′,N′-tetra-(p-chlorobenzyl)-p-phenylenediamine, N,N,N′,N′-tetramethyl-p-phenylenediamine, N,N,N′,N′-tetrabenzyl-m-phenylenediamine, N,N,N′,N′-tetramethylbenzidine, N,N,N′,N′-tetrabenzylbenzidine, N,N,N′,N′-tetraphenyl-p-phenylenediamine, N,N,N′,N′-tetraphenyl-m-phenylenediamine, 1,1-bis[4-(dibenzylamino)phenyl]ethane, 1,1-bis[4-(dibenzylamino)phenyl]propane, 1,1-bis[4-(dibenzylamino)-phenyl]butane, 1,1-bis[4-(dibenzylamino)phenyl]-2-methylpropane, 2,2-bis[4-(dibenzylamino)phenyl]propane, 2,2-bis[4-(dibenzylamino)phenyl]butane, 1,1-bis[4-[di(m-methylbenzyl)amino]phenyl]propane, 1,1-bis[p-(dimethylamino)phenyl]-1-phenylmethane, 1,1-bis[p-(diethylamino)phenyl]-1-phenylmethane, bis[4-(dibenzylamino)phenyl]methane, bis[4-[di(p-chlorobenzyl-)amino]phenyl]methane, 1,1-bis[p-(dimethylamino)-phenyl]-1-phenylethane, 4,4′-benzylidenebis(N,N-dimethyl-m-toluidine), 4′,4″-bis(diethylamino)-2,6-dichloro-2′,2″-dimethyltriphenylmethane, 1,1-bis[4-(diethylamino)-2-methylphenyl]-1-$\alpha$-naphthylmethane, 4′,4″-bis(dimethylamino)-2-chloro-2′,2″-dimethyltriphenylmethane, 1,1-bis[p-(diethylamino)phenyl]-1-phenylethane, 1,1-diphenyl-5,5-bis[4-(diethylamino)-2-methylphenyl]-1,3-pentadiene, 1,1-diphenyl-3,3-bis[4-(diethylamino)-2-methylphenyl]-1-propene, bis[4-(dibenzylamino)phenyl]ether, bis[4-(diethylamino)-phenyl]ether, bis[4-(dibenzylamino)phenyl]sulfide, 2,2-bis[4-(di-p-tolylamino)phenyl]propane, 1,1-bis[4-(di-p-tolylamino)phenyl]-1-phenylethane, and 1,1-bis[4-dibenzylamino)phenyl]-1,1-diphenylmethane.

(iv) Aromatic tertiary triamino compounds:

Tris[4-(diethylamino)phenyl]methane, 1,1-bis[4-(diethylamino)-2-methylphenyl]-1-[4-(dimethylamino)-phenyl]methane.

(v) Condensed products:

Condensed products of aldehyde and aromatic amines, condensed products of tertiary aromatic amines and aromatic halides, condensed products of formaldehyde and condensed aromatic compounds and poly-p-phenylene-1,3,4-oxadiazole.

(vi) Metal-containing compounds:

2-Mercaptobenzotiazole lead salt, 2-mercaptobenzothiazole zinc salt, 2-mercaptobenzothiazole copper salt, 2-mercaptobenzoxazole lead salt, 2-mercapto-5-phenylbenzoxazole lead salt, 2-mercapto-6-methoxybenzimidazole lead salt, 8-hydroxyquinoline magnesium salt, 8-hydroxyquinoline aluminum salt, 8-hydroxyquinoline lead salt, 7-benzyl-8-hydroxyquinoline copper salt, and 2-hydroxy-4-methylazobenzene copper salt.

(vii) Heterocyclic compounds:

(a) Pyrazoline derivatives:

1,3,5-Triphenylpyrazoline, 1-phenyl-3-[p-dimethylamino)styryl]-5-[p-(dimethylamino)phenyl]pyrazoline, 1,5-diphenyl-3-styrylpyrazoline, 1,3-diphenyl-5-styrylpyrazoline, 1,3-diphenyl-5-[p-(dimethylamino)-phenyl]pyrazoline, and 1,3-diphenyl-5-(2-furyl)pyrazoline.

(b) 1,2,4-Triazine derivatives:

3-[p-(Dimethylamino)phenyl]-5,6-di(p-dimethoxyphenyl)1,2,4-triazine, 3-[p-(dimethylamino)phenyl]-5,6-di(2-pyridyl)-1,2,4-triazine, 3-[p-(dimethylamino)-phenyl]-5,6-di(p-ethoxyphenyl)-1,2,4-triazine, 3-[p-(diethylamino)phenyl]-5,6-di(p-methoxyphenyl)-1,2,4-triazine, 3-[p-(diethylamino)phenyl]-5,6-di(p-ethoxyphenyl)-1,2,4-triazine.

(c) Quinazoline derivatives:

2,4-Diphenylquinazoline, 2-phenyl-4-p-tolylquinazoline, 2-phenyl-4-[4-(dimethylamino)phenyl]quinazoline, 2-phenyl-4-styrylquinazoline, and 2,4-diphenylbenzo[h-]quinazoline.

(d) Benzofuran derivatives:

6-Hydroxy-2-phenyl-3-[4-(dimethylamino)phenyl]-benzofuran, 6-hydroxy-2,3-di(4-methoxyphenyl)benzofuran, 2,3,5,6-tetra(4-methoxyphenyl)benzo[1,2-b:5,4-b']difuran.

(e) Oxadiazole derivatives:

2,5-Bis[4-(dimethylamino)phenyl]-1,3,4-oxadiazole, 2,5-bis[4-(diethylamino)phenyl]-1,3,4-oxadiazole, 2,5-bis[4-(isoamylamino)phenyl]-1,3,4-oxadiazole, 2,5-bis[4-(cyclopentylamino)phenyl]-1,3,4-oxadiazole, and 2,5-bis[4-(ethylamino)phenyl]-1,3,4-oxadiazole.

The photoconductive composition of this invention may further contain a component (b) which is a sensitizing dye capable of increasing the light sensitivity of the organic photoconductor. Component (b) may be a sensitizing dyes known in the field of dye sensitization techniques for organic photoconductors. Typical examples of these sensitizing dyes are disclosed in, "Society of Photographic Scientists and Engineers", 19, 60–64(1975); "Applied Optics", suppl., 3, 50(1969); U.S. Pat. Nos. 3,037,861; 3,250,615; 3,712,811 (incorporated herein by reference to disclose such sensitizing dyes); British Pat. No. 1,353,264; "Research Disclosures"; #10938 (109, May, 1973, page 62 and followings); U.S. Pat. Nos. 3,141,700 and 3,938,994; Japanese Patent Application (OPI) Nos. 14,560/'71; 14,561/'71; 29,586/'71; 29,587/'71; 65,885/'71; 35,141/'71, etc., and Japanese Patent Application No. 114,259/'70.

Component (b) is properly selected from these known sensitizing dyes and other sensitizing dyes, which can increase the light sensitivity of the high molecular organic photoconductor employed for the photoconductive composition of this invention.

These sensitizing dyes are used in an amount capable of increasing the sensitivity of the organic photoconductor (a). The amount of the sensitizing dye depends upon the type used. However, they are generally used in an amount in the range of from about 0.01% to about 100% by weight, preferably from about 0.1% to about 30% by weight based on the amount of the high molecular organic photoconductor.

The thiourea compounds represented by general formula I or II, which are the component (c) of this invention, can be prepared by the methods described in "J. Chem. Soc.", 1573–1581(1955) (incorporated herein by reference to disclose such method of preparation). In addition, these thiourea compounds are effective for organic photoconductors as well as inorganic photoconductors dye-sensitized by ZnO, etc.

When some of $R^1$ to $R^6$ in general formula I or II are an alkyl group, they may be straight chain or branched substituted or unsubstituted alkyl groups each having 1 to 22 carbon atoms, preferably 1 to 5 carbon atoms. In this case, it is preferred that one of said $R^1$ and $R^2$ or one of said $R^3$ and $R^4$ is a hydrogen atom or a straight chain or branched alkyl group having 1–5 carbon atoms. Examples of the substituent bonded to the alkyl group include a halogen atom (chlorine atom, bromine atom, fluorine atom, etc.), a cyano group, a nitro group, a phenyl group, and a tolyl group. These may be from 1 to 3 substituents.

When some of $R^1$ to $R^6$ are a monocyclic or bicyclic condensed aryl group, they may be a substituted or unsubstituted phenyl group or a substituted or unsubstituted naphthyl group. Examples of the substituent for these groups, include a halogen atom (chlorine atom, bromine atom, fluorine atom, etc.), a cyano group, a nitro group, a straight chain or branched alkyl group having 1–5 carbon atoms, a carboxy group, an alkoxycarbonyl group, and a straight chain or branched alkyl group having 1–5 carbon atoms or straight chain or branched alkoxy group having 1–5 carbon atoms substituted by 1–3 substituents such as cyano group, nitro group, and halogen atom (chlorine atom, bromine atom, fluorine atom, etc.). When the foregoing group is substituted by 2 or 3 substituents, they may be the same of different. When the foregoing aryl group is substituted, 1 to 3 substituents may be present and when there are 2 or 3 substituents they may be the same or different.

When some of $R^1$ to $R^6$ are a monovalent group induced from a monocyclic or bicyclic condensed heterocyclic ring, examples of the monovalent group are a pyrrolidinyl group, a piperidinyl group, a piperidino group, a morpholinyl group, a morpholino group, a pyrrolyl group, an imidazolyl group, a pyridyl group, a pyrimidinyl group, an indolinyl group, an isoindolinyl group, an indolyl group, an isoindolyl group, a benzimiazolyl group, a quinolyl group and an isoquinolyl group. These groups may have 1 to 3 substituents such as a halogen atom (chlorine atom, bromine atom, fluorine atom, etc.), a cyano group, a nitro group, a phenyl group, a tolyl group, a benzyl group, a phentyl group, and a straight chain or branched alkyl group having 1–5 carbon atoms (when the number of the substituent is 2 or 3, the substituents may be the same or different).

When said $R^1$ and $R^2$ or said $R^3$ and $R^4$ are combined with each other, examples of the combined group are divalent groups such as a trimethylene group, a tetramethylene group, a pentamethylene group and oxydiethylene group ($—CH_2—CH_2—O—CH_2—CH_2—$). Furthermore, these divalent groups may be substituted with 1–3 halogen atom (chlorine atom, bromine atom, fluorine atom, etc.), a cyano group, a nitro group, a phenyl group, a tolyl group, a benzyl group, a phenetyl group, and a straight chain or branched alkyl group having 1–5 carbon atoms.

When $R^7$ is a divalent arylene group, practical examples of it are a p-phenylene group, a m-phenylene group, an o-phenylene group, a 1,4-naphthylene group, a 2,3-naphthylene group, and a 4,4'-biphenylene group. When $R^7$ is a polymethylene group, they may be polymethylene groups having 1 to 10, preferably 1 to 5 carbon atoms. Also, when $R^7$ is an alkylene group, they may be a propylene group, a butylene group, a pentylidene group, a 1,2-dimethylethylene group, a 1,3-dimethyltrimethylene group, a 1,4-dimethyltetramethylene group, a 1,5-dimethylpentamethylene group, a 1,6-dimethylhexamethylene group, a 1-ethylethylene group, and a 1,2-diethylethylene group.

Preferred thiourea compounds of the present invention which give high light sensitivity are shown by following general formulae III to VIII:

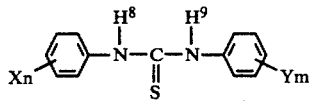
(III)

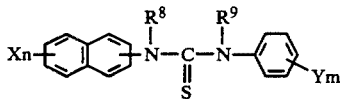
(IV)

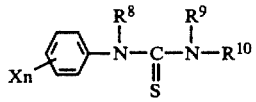
(V)

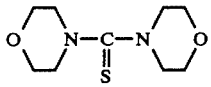
(VI)

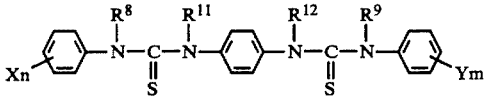
(VII)

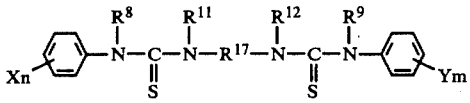
(VIII)

wherein, $R^8$, $R^9$, $R^{11}$, and $R^{12}$, which may be the same or different, each represents a hydrogen atom, a straight chain or branched alkyl group having 1 to 5 carbon atoms, or a substituted or unsubstituted phenyl group. Examples of the substituent of the substituted phenyl group are a halogen atom (chlorine atom, bromine atom, fluorine atom), a straight chain or branched alkyl group having 1 to 5 carbon atoms, a cyano group, a nitro group, a methoxy group, an ethoxy group, a propoxy group, a carboxymethyl group, and a carboxyethyl group. The number of the substituent is 1 to 3 and when the phenyl group has 2 or 3 substituents, they may be the same or different.

$R^{10}$ represents a substituted or unsubstituted straight chain or branched alkyl group having 1 to 10, preferably 1 to 5 carbon atoms. The substituent of the alkyl group is a cyano group, a nitro group, or a halogen atom.

$R^{13}$ represents a polymethylene group or an alkylene group, having 1 to 10, preferably 1 to 5 carbon atoms.

X and Y each is an electron attractive group and represents a substituted or unsubstituted straight chain or branched alkyl group having 1 to 5 carbon atoms, methoxy group, an ethoxy group, a propoxy group, a methoxycarbonyl group, an ethoxycarbonyl group, a propoxycarbonyl group, a halogen atom (chlorine atom, bromine atom, fluorine atom, etc.), a cyano group, a nitro group, a carboxymethyl group, or a carboxyethyl group. The substituent of the substituted alkyl group is a cyano group, a nitro group, or a halogen atom (chlorine atom, bromine atom, fluorine atom, etc.).

Also, m and n each represents 0, 1, 2, or 3. When m and n each is O, X and Y both are hydrogen and do not represent any substituent. When m and n each represents 2 or 3, the substituents may be the same or different.

Furthermore, $R^8$, $R^9$, $R^{10}$, $R^{11}$, $R^{12}$, X, and Y may be the same or different.

Preferred examples of the thiourea compound of the general formulae III to VIII are those of the general formulae III and V.

Preferred example of the thiourea compound of the present invention which are encompassed by general formula III are thiocarbanilide

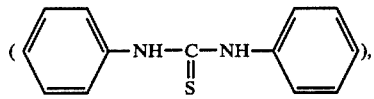

4-chlorothiocarbanilide, 4,4'-dichlorothiocarbanilide, 4-chloro-4'-bromothiocarbanilide, 4,3'-dichlorothiocarbanilide, 4-bromothiocarbanilide, 4,4'-dibromothiocarbanilide, 4,3'-dibromothiocarbanilide, 4-fluorothiocarbanilide, 4,4'-difluorothiocarbanilide, 4-cyanothiocarbanilide, 4,4'-dicyanothiocarbanilide, 4-nitrothiocarbanilide, 4-methyl-4'-chlorothiocarbanilide, 4-ethyl-4'-cyanothiocarbanilide, N-methyl-N-phenyl-N'-(4-chlorophenyl)thiourea, and bis(N-ethyl-N-phenyl)thiourea.

Preferred examples of the thiourea compound of the present invention which are encompassed by the general formula IV are N-(1-naphthyl)-N'-phenylthiourea, N-(2-naphthyl)-N'-phenylthiourea, N-(1-naphthyl)-N'-(4-chlorophenyl)thiourea, N-(2-naphthyl)-N'-(4-chlorophenyl)thiourea, N-(1-naphthyl)-N'-(4-bromophenyl)-thiourea, N-(1-naphthyl)-N'-(4-tolyl)thiourea, N-(1-naphthyl)-N'-(2-methyl-4-chlorophenyl)thiourea.

Preferred examples of the thiourea compound of the present invention which are encompassed by the general formula V are N-phenyl-N'-ethylthiourea, N-phenyl-N'-(n-butyl)thiourea, N-phenyl-N'-octylthiourea, N-(4-chlorophenyl)-N'-ethylthiourea, N-(4-chlorophenyl)-N'-octylthiourea, N-(4-bromophenyl)-N'-ethylthiourea, N-(4-cyanophenyl)-N'-ethylthiourea, and N-(4-chlorophenyl)-N,N'-diethylthiourea.

Preferred examples of the thiourea compound of the present invention which are encompassed by the general formula VII and N,N'-bis(phenylthiocarbamoyl)-1,4-phenylenediamine, N,N'-bis(p-chlorophenylthiocarbamoyl)-1,4-phenylenediamine, N-(p-chlorophenylthiocarbamoyl)-N'-(phenylthiocarbamoyl)-1,4-phenylenediamine, N,N'-bis(p-bromophenylthiocarbamoyl)-1,4-phenylenediamine, N-(p-chlorophenylthiocarbamoyl)-N'-(p-bromophenylthiocarbamoyl)-1,4-phenylenediamine, N-(p-methylphenylthiocarbamoyl)-N'-(p-cyanophenylthiocarbamoyl)-1,4-phenylenediamine, N-(p-ethylphenylthiocarbamoyl)-N'-(p-nitrophenylthiocarbamoyl)-1,4-phenylenediamine, N,N'-diethyl-N,N'-bis[N-ethyl-N-(p-chlorophenyl)thiocarbamoyl]-1,4-phenylenediamine.

Preferred example of the thioureas compound of the present invention which are encompassed by the general formula VIII are N,N'-bis(phenylthiocarbamoyl)ethylenediamine, N,N'-bis(p-chlorophenylthiocarbamoyl)ethylenediamine, N,N'-bis(p-bromophenylthiocarbamoyl)ethylenediamine, N,N-bis(p-chlorophenylthiocarbamoyl)hexamethylenediamine, and N,N'-bis(p-cyanophenylthiocarbamoyl)hexamethylenediamine.

The photoconductor compositions of this invention may further contain, if necessary, structure agents, plasticizers, dyes, pigments, etc., in ranges which do not reduce the characteristics of the photoconductive compositions.

Examples of structure agents used in this invention include cyanoethyl cellulose, nitrile rubber, polycarbonate of bisphenol A, a copolymer of lineal polyester and butadiene, a copolymer of vinylidene chloride and acrylonitrile, etc. Examples of plasticizers used in this invention include biphenyl chloride, epoxy resin, triphenylmethane compounds, cumarone resins, low molecular weight xylene resins, etc.

The photoconductive composition of this invention can be prepared by forming a dispersion or a uniform solution by dispersing of dissolving the foregoing three components. Other additives may be added in desired ratio in a solvent. The dispersion or the solution is then applied to a proper support. The common solvent is then removed by a means such as by evaporation. Depending on the situation the photoconductive composition may be used in the form of a dispersion or solution without completely removing the solvent. The electrophotographic photosensitive material of this invention is prepared by coating the photoconductive composition dispersion or solution thus obtained on a support having a conductive surface. The coating is then dried to form a photoconductive layer. Depending on the particular situation, addition layer may be included such as an adhesive layer.

Examples of the common solvent include benzene, toluene, xylene, chlorobenzene, dichloromethane, dichloroethane, trichloroethane, cyclohexanone, tetrahydrofuran, dioxane, etc., and a solvent which can dissolve or disperse the high molecular organic photoconductor, the thiourea compound shown by general formula I or II, the sensitizing dye, and, if necessary, the other additives. Single solvents or mixtures may be used.

The proportion of the thiourea compound shown by general formula I or II in the photoconductive composition is based on the amount of the organic photoconductor contributing the photoconductivity and insulating property. The proportion of the thiourea compound shown by general formula I or II is generally from 0.1 part by weight to 100 parts by weight, preferably from 3 parts by weight to 30 parts by weight per 100 parts by weight of the organic photoconductor. When the proportion of the thiourea compound is outside the foregoing range, it causes bad influences such as the reduction in light sensitivity of the photoconductive compositions and increase in residual potential.

Examples of supports having a conductive surface used for the electrophotographic photosensitive materials of this invention, include drums or sheets of a metal such as aluminum, copper, iron or zinc; and papers, plastics, and glasses the surfaces of which are subjected to conductive treatment by methods such as vapor deposition of a metal such as aluminum, copper, zinc, indium, etc.; deposition of a conductive metal compound such as $In_2O_3$, $SnO_2$, etc.; lamination of a metal foil; and coating of a dispersion of carbon black, a conductive metal compound (e.g., $In_2O_3$, $SnO_2$) powder, or a metal powder in a polymer binder.

Fine particles of the photoconductive composition of this invention may be dispersed in an insulating solvent and may be used for forming images by an electrophoresis imaging method described in U.S. Pat. Nos. 3,384,565; 3,384,488; 3,510,419, etc. (corresponding to Japanese Patent Publication Nos. 21781/68; 37125/72; 36079/71, respectively).

The invention will now be described in detail by the following examples. However, the invention is not limited to these examples.

Example 1 and Comparison Example 1

A photoconductive composition solution was prepared by dissolving 10 g of poly-N-vinylcarbazole (PVCz) in 100 ml of 1,2-dichloroethane and 250 mg of 2,6-di-t-butyl-4-[4-(N-methyl-N-2-cyanoethylamino)-styryl]thiapyrylium tetrafluoroborate (sensitizing dye) was added to the solution. The mixture was coated on a polyethylene terephthalate (PET) film 100 μm thick having an $In_2O_3$ vapor-deposited layer (conductive layer) 60 n. m. thick and dried to remove the common solvent and to form a photoconductive layer (electrophotographic photosensitive layer) of 5 μm thick, thereby an electrophotographic film No. 1 was prepared.

Each of the thiourea compounds of general formulae III–VIII shown in Table 1 was then added to a part of the foregoing photoconductive composition solution in the amount (shown by weight percent) to PVCz also shown in Table 1 to provide photoconductive composition solutions and each solution was coated on the same PET film having a conductive surface as when preparing the electrophotographic film No. 1. The coatings were dried to remove the common solvent and form a photoconductive layer (electrophotographic photosensitive layer) 5 μm thick, thereby electrophotographic films No. 2 to No. 12 were prepared.

The electrophotographic characteristics were measured on the electrophotographic films No. 1 to No. 12 thus prepared and the results obtained are shown in Table 1. The electrophotographic characteristics were evaluated by charging the photoconductive layer of each electrophotographic film in the dark using a corona charging device so that the surface potential became +500 volts and then measuring the decay of the surface potential in the dark and the decay thereof under light exposure. The charge retention is expressed by the percentage of the surface potential ($V_{70}$) of the photoconductive layer after 70 seconds since charging in the dark to the surface potential ($V_{10}$) of the photoconductive layer after 10 seconds. The larger value shows a larger charge retention power of the photoconductive layer in the dark. A residual potential is the surface potential at 20 seconds after light exposure. A small residual potential means excellent electrophotographic characteristics. Also, sensitivity $E_{50}$ shows a half decay exposure amount and sensitivity $E_{90}$ shows an exposure amount for decaying 90% of the surface potential. The smaller values show the light sensitivity of the photoconductive layer being higher.

TABLE 1

| Electrophotographic Film | | Thiourea Compound: Structural formula | Amount (wt %) | Electric Change-Retention Ability $V_{70}/V_{10}$ (%) | Light Sensitivity at Wavelength of 630 nm (erg/cm$^2$) $E_{50}$ | $E_{90}$ |
|---|---|---|---|---|---|---|
| (Comparison) | No. 1 | — | — | 85 | 77 | 441 |
| | No. 2 | 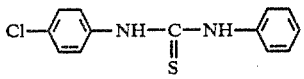 | 5 | 85 | 53 | 328 |
| (Invention) | | | | | | |
| | No. 3 | 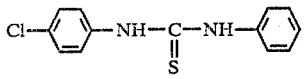 | 10 | 85 | 45 | 254 |
| | No. 4 | 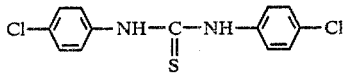 | 5 | 85 | 47 | 268 |
| | No. 5 | 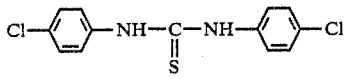 | 10 | 82 | 35 | 196 |
| | No. 6 | 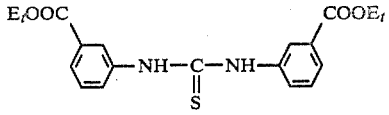 | 10 | 88 | 55 | 333 |
| | No. 7 | 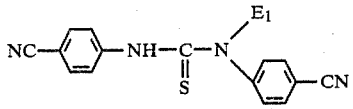 | 10 | 86 | 70 | 390 |
| | No. 8 | 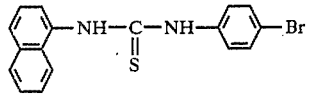 | 10 | 87 | 60 | 325 |
| (Invention) | | | | | | |
| | No. 9 | 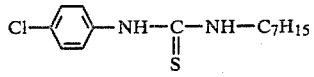 | 10 | 85 | 72 | 420 |
| | No. 10 | 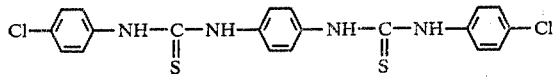 | 10 | 88 | 61 | 326 |
| | No. 11 | 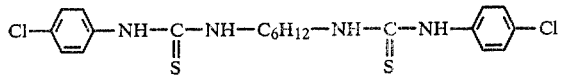 | 10 | 87 | 58 | 376 |
| | No. 12 | 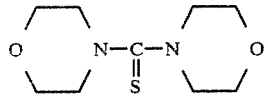 | 10 | 80 | 68 | 396 |

Example 2 and Comparison Example 2

By following the same procedure as in Example 1 using the sensitizing dyes shown in Table 2 in place of 2,6-di-t-butyl-4-[4-(N-methyl-N-2-cyanoethylaminostyryl]-thiapurylium tetrafluoroborate used in Example 1, electrophotographic films No. 13, No. 15, No. 17, and No. 19 were prepared. Also, by following the same procedure as above while further adding 4-chlorothiocarbanilide in each case, electrophotographic films No. 14, No. 16, No. 18, and No. 20 were prepared. The electrophotographic characteristics of these samples were measured in the same manner as in Example 1 and the results are shown in Table 2.

TABLE 2

| Electrophotographic Film | Senitizing Dye | Electric Change-Retention Ability $V_{70}V_{10}$ (%) | Light Sensitivity at Wavelength of 630 nm (erg/cm$^2$) $E_{50}$ | $E_{90}$ |
|---|---|---|---|---|
| No. 13 (Comparison) | 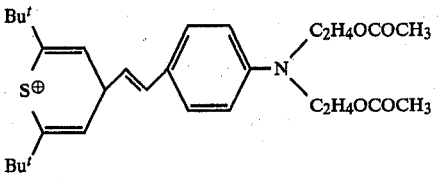 | 88 | 77 | 450 |
| No. 14 (Invention) | $BF_4^{\ominus}$ | 89 | 67 | 315 |
| No. 15 (Comparison) | 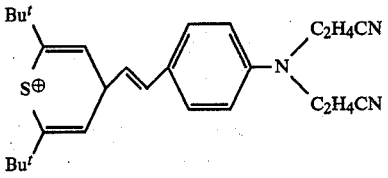 | 83 | 66 | 392 |
| No. 16 (Invention) | $ClO_4^-$ | 86 | 49 | 237 |
| No. 17 (Comparison) | 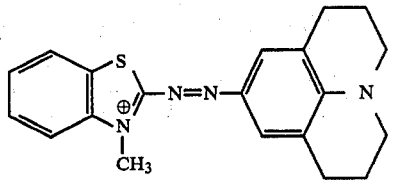 | 82 | 228 | 4200 |
| No. 18 (Invention) | $ClO_4^{\ominus}$ | 82 | 162 | 1450 |
| No. 19 (Comparison) | 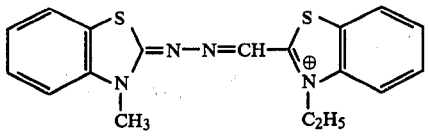 | 90 | 266 | 1460 |
| No. 20 (Invention) | $ClO_4^{\ominus}$ | 93 | 131 | 657 |

Note:
In the above structural formulae, the symbol $Bu^t$ indicates a tert-butyl group.

Example 3 and Comparison Example 3

The photoconductive composition solution having the composition shown below was coated on a PET film having the conductive layer as in Example 1. The coating was dried to remove the common solvent and form a photoconductive layer 5 μm thick, thereby electrophotographic film No. 21 was prepared. Also, 4,4'-dichlorothiocarbanilide was further added to the photoconductive composition solution having the below-showing composition in an amount of 5% by weight of 1,1-bis(p-dimethylaminophenyl)-1-phenylmethane and an electrophotographic film No. 22 was prepared by following the same procedure as above using the photoconductive composition solution. The electrophotographic characteristics of these electrophotographic films were measured as in Example 1 using a tungsten lamp and the results are shown in Table 3.

| | |
|---|---|
| Polycarbonate<br>Polycarbonate prepared by an ester exchange of diphenylcarbonate and 2,2-bis(4-hydroxyphenyl)propane | 10 weight parts |
| 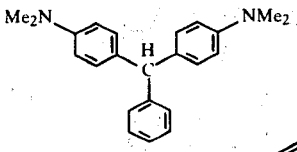 | 8 weight parts |
| 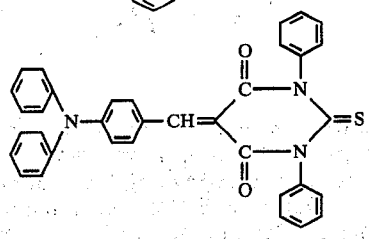 | 0.8 weight part |

-continued

| | |
|---|---|
| Methylene chloride | 150 weight parts |

TABLE 3

| Electrophotographic Film | Charge Retention Power ($V_{70}/V_{10}$ %) | Sensitivity by W-lamp $E_{50}$ (lux.sec.) | $E_{90}$ (lux.sec.) |
|---|---|---|---|
| No. 21 (comparison) | 93 | 50 | 350 |
| No. 22 (Invention) | 91 | 42 | 260 |

From the above results, it is clear that the electrophotographic films Nos. 2, 12, 14, 16, 18, 20, and 22 of this invention having the electrophotographic photosensitive layers composed of the photoconductive compositions of this invention have high light sensitivity as compared to known electrophotographic films, i.e. (comparison examples) Nos. 1, 13, 15, 19 and 21 having the electrophotographic photosensitive layers composed of the known photoconductive compositions.

While the invention has been described in detail and with reference to specific embodiments thereof, it will be apparent to one skilled in the art that various changes and modifications can be made therein without departing from the spirit and scope thereof.

What is claimed is:

1. A photoconductive composition comprising an organic photoconductor and a thiourea compound as shown by the following general formulae III to VIII:

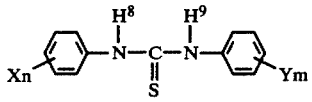
(III)

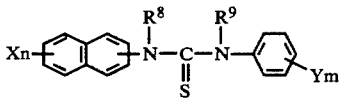
(IV)

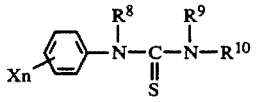
(V)

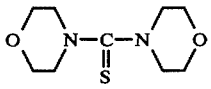
(VI)

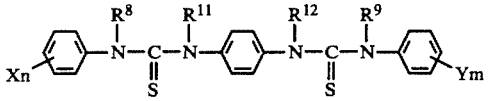
(VII)

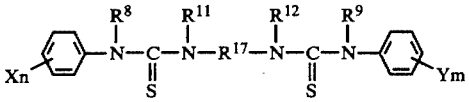
(VIII)

wherein, $R^8$, $R^9$, $R^{11}$, and $R^{12}$, which may be the same or different, each represents a hydrogen atom, a straight chain or branched alkyl group having 1 to 5 carbon atoms, or a sustituted or unsubstituted phenyl group wherein the number of the substituent is 1 to 3 and when the phenyl group has 2 or 3 substituents, they may be the same or different;

$R^{10}$ represents a substituted or unsubstituted straight chain or branched alkyl group having 1 to 10 carbon atoms wherein the substituent of the alkyl group is a cyano group, a nitro group, or a halogen atom;

$R^{13}$ represents a polymethylene group or an alkylene group, having 1 to 10 carbon atoms;

X and Y each is an electron attractive group and represents a substituted or unsubstituted straight chain or branched alkyl group having 1 to 5 carbon atoms, a methoxy group, an ethoxy group, a propoxy group, a methoxycarbonyl group, an ethoxycarbonyl group, a propoxycarbonyl group, a halogen atom, a cyano group, a nitro group, a carboxymethyl group, or a carboxyethyl group wherein the substituent of the substituted alkyl group is a cyano group, a nitro group, or a halogen atom;

m and n each represents 0, 1, 2, or 3;

when m and n each is O, X and Y both are hydrogen and do not represent any substituent;

when m and n each represents 2 or 3, the substituents may be the same or different; and $R^8$, $R^9$, $R^{10}$, $R^{11}$, $R^{12}$, X, and Y may be the same or different.

2. The photoconductive composition as claimed in claim 1 wherein said composition further contains a sensitizing dye capable of increasing the light sensitivity of the organic photoconductor.

3. An electrophotographic photosensitive material comprising a support having electric conductivity at the surface thereof having formed thereon a layer of a photoconductive composition comprising an organic photoconductor and a thiourea compound.

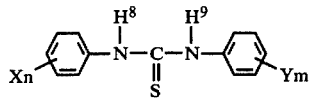
(III)

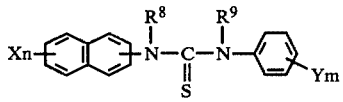
(IV)

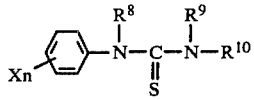
(V)

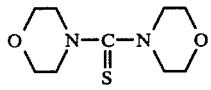
(VI)

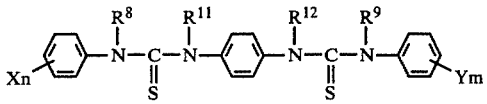
(VII)

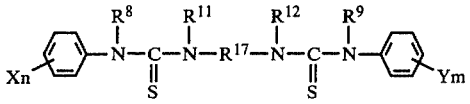
(VIII)

wherein, $R^8$, $R^9$, $R^{11}$, and $R^{12}$, which may be the same or different, each represents a hydrogen atom, a straight chain or branched alkyl group having 1 to 5 carbon atoms, or a sustituted or unsubstituted phenyl group wherein the number of the substituent is 1 to 3 and when the phenyl group has 2 or 3 substituents, they may be the same or different;

$R^{10}$ represents a substituted or unsubstituted straight chain or branched alkyl group having 1 to 10 carbon atoms wherein the substituent of the alkyl group is a cyano group, a nitro group, or a halogen atom;

$R^{13}$ represents a polymethylene group or an alkylene group, having 1 to 10 carbon atoms;

X and Y each is an electron attractive group and represents a substituted or unsubstituted straight chain or branched alkyl group having 1 to 5 carbon atoms, a methoxy group, an ethoxy group, a propoxy group, a methoxycarbonyl group, an ethoxycarbonyl group, a propoxycarbonyl group, a halogen atom, a cyano group, a nitro group, a carboxymethyl group, or a carboxyethyl group wherein the substituent of the substituted alkyl group is a cyano group, a nitro group, or a halogen atom;

m and n each represents 0, 1, 2, or 3;

when m and n each is O, X and Y both are hydrogen and do not represent any substituent;

when m and n each represent 2 or 3, the substituents may be the same or different; and $R^8$, $R^9$, $R^{10}$, $R^{11}$, $R^{12}$, X, and Y may be the same or different.

4. An image from the process which comprises applying charges on an electrophotographic photosensitive material of claim 3, image-wise exposing, and then developing.

5. The electrophotographic photosensitive material as claimed in claim 3 wherein the layer of the photoconductive composition further contains a sensitizing dye capable of increasing the light sensitivity of the organic photoconductor.

6. A photoconductive composition as claimed in claim 1, wherein one of $R^1$ and $R^2$ is a hydrogen atom or a straight chain or banch chain alkyl group having 1–5 carbon atoms.

7. A photoconductive composition as claimed in claim 1, wherein the thiourea compound is present in an amount of 0.1 parts by weight to 100 parts by weight per 100 parts by weight of the organic photoconductor.

8. A photoconductive composition as claimed in claim 7, wherein the thiourea compound is present in an amount of 3 parts by weight to 30 parts by weight per 100 parts by weight of the organic photoconductor.

* * * * *